US007100761B2

(12) United States Patent
Helzer et al.

(10) Patent No.: US 7,100,761 B2
(45) Date of Patent: Sep. 5, 2006

(54) ROTATABLE COIN DISPLAY

(75) Inventors: James A. Helzer, Cheyenne, WY (US); Max A. DeHerrera, Cheyenne, WY (US)

(73) Assignee: Unicover Corporation, Cheyenne, WY (US)

( * ) Notice: Subject to any disclaimer, the term of this patent is extended or adjusted under 35 U.S.C. 154(b) by 144 days.

(21) Appl. No.: 10/661,374

(22) Filed: Sep. 12, 2003

(65) Prior Publication Data

US 2004/0124110 A1 Jul. 1, 2004

Related U.S. Application Data

(60) Provisional application No. 60/410,332, filed on Sep. 12, 2002.

(51) Int. Cl.
*A45C 1/00* (2006.01)
*B65D 73/00* (2006.01)

(52) U.S. Cl. ..... 206/0.8; 206/462

(58) Field of Classification Search ..... 206/0.8–0.84, 206/6.1, 461–471, 472–475, 477–483, 484–484.2, 206/486–490, 525, 557–566, 733–734, 775–783
See application file for complete search history.

(56) References Cited

U.S. PATENT DOCUMENTS 2,129,879 A * 9/1938 Samuel ..... 206/775
2,258,535 A 10/1941 Buranelli
2,457,998 A * 1/1949 Winter et al. ..... 206/0.83
2,597,227 A 5/1952 Colliton
2,971,638 A * 2/1961 Allison et al. ..... 206/467
3,025,952 A * 3/1962 Phipps ..... 206/533
3,100,567 A 8/1963 Levy
3,139,977 A * 7/1964 Burdick ..... 206/0.83
3,193,090 A 7/1965 Hudgeons, Jr. et al.
3,199,666 A * 8/1965 Burdick ..... 206/0.82

(Continued)

FOREIGN PATENT DOCUMENTS

DE 25 51 095 A 5/1977

(Continued)

*Primary Examiner*—Bryon P. Gehman
(74) *Attorney, Agent, or Firm*—Hamilton, Brook, Smith & Reynolds, P.C.

(57) ABSTRACT

A display for a collectible item, such as a coin, in which the collectible item may be rotated relative to the display. In one embodiment, the display comprises a bubble, which can be a semi-rigid transparent material, supported between at least two layers of support material, which can be a rigid material such as card-stock, which are adhered together. The bubble includes a capsule for encapsulating the collectible item, and a flange extending from an outer perimeter of the capsule. The capsule of the bubble is aligned within an opening in the support material so that the collectible item may be viewed. The flange contacts the support layers, and permits the bubble to be rotated within the display. The display also includes an apparatus for rotatably securing the flange between the support layers, which can be a high-gloss heat-resistant coating applied to the support layers over the areas in which the support layers contact the flange. The display can also include a third support layer between the first and second layers. The third layer has an opening that is slightly larger than the flange, so that the flange is located within the opening. The third layer preferably has a thickness that is substantially equal to the thickness of the flange to help minimize the formation of "humps" in the display caused by the added thickness of the flange. Methods for producing such a rotatable display are also disclosed.

23 Claims, 2 Drawing Sheets

U.S. PATENT DOCUMENTS 3,212,637 A * 10/1965 Shippee ..... 206/462
3,788,464 A * 1/1974 Skinner ..... 206/0.82
3,913,732 A 10/1975 Peterson
4,063,639 A * 12/1977 Grant ..... 206/0.82
4,270,659 A 6/1981 Kuchenbecker
4,385,688 A * 5/1983 Grant ..... 206/0.83

FOREIGN PATENT DOCUMENTS

DE 202 00 976 U 1 5/2002

* cited by examiner

ROTATABLE COIN DISPLAY

RELATED APPLICATION(S)

This application claims the benefit of U.S. Provisional Application No. 60/410,332, filed Sep. 12, 2002, the entire teachings of which are incorporated herein by reference.

BACKGROUND OF THE INVENTION

A number of techniques exist for mounting and displaying coins. In general, coin displays fall into one of four categories: (1) devices which allow the user to snap an unprotected coin into a paper board cutout that is essentially the same size as the coin (such as a Whitman™ coin folder); (2) hard plastic capsules which encapsulate a coin and allow it to be displayed in a box or album; (3) flexible laminated mylar/polyethelyne and similar packagings which allow a coin to be sandwiched between two layers of material; and (4) coin "bubbles" which generally comprise semi-rigid plastic materials which are vacuum-formed to the size and shape of the coin, and which allow the coin to be encapsulated and mounted on or between other rigid materials, such as two layers of card stock.

With any of these types of displays, and particularly in the case of a display having a coin "bubble," the assembly process must provide careful orientation of the coin within the display packaging, so that in the finished product, the coin is properly aligned relative to the surrounding elements of the display. Proper rotational alignment of the coin within the surrounding packaging of the display is an important consideration for many customers, and even a minuscule rotation of the coin within the display can cause consumer dissatisfaction. Also, because the "ideal" coin alignment is a matter of personal preference, customers are sometimes dissatisfied even when the coins are properly aligned in the display. The problem of maintaining rotational alignment is compounded when multiple coins are provided in a single display. This rotational alignment problem results in a significant increase in manufacturing costs in order to assure consistent quality for the displays.

Attempts have been made to provide a coin display in which the coins are sealed in the product in such a way that the coins can be rotated within the product even after assembly. With these displays, the alignment of the coins can be adjusted by the customer to his or her satisfaction when the product is in the consumer's hands.

This approach does suffer from some drawbacks. For instance, the "bubbles" into which the coins are sealed include concentric flanges which hold the bubble in place between two layers of card stock material. The adhesive used to join the cards together tends to adhere to the flange, which can make rotation of the coin in the display extremely difficult, if not impossible. Also, the flange portion of the bubble adds thickness between the layers of card stock used in the display assembly. This results in the formation of a noticeable "hump" in the card stock surrounding the coin, which is undesirable for many applications. For instance, when these "humps" are present in the coin display, the resultant uneven surface of the display makes manufacturing such displays difficult. The sealing head used to form the laminate structure must often be specially machined to relieve the pressure and distortions caused by these uneven surfaces.

In a rotatable coin display, the layers of card stock surrounding the coin bubble can be adhered to one another using a variety of adhesives, including contact latex-based adhesives, or heat and pressure activated adhesives. Latex-based adhesives have the advantage of being able to be assembled without special equipment. However, the adhesive itself typically contains chlorine, sulfur, or other compounds which, over time, react with the coins and result in their discoloration. Heat and pressure activated adhesives are available which are essentially inert and do not react with the coins, although these adhesives must be activated using special equipment. In addition, the heat and pressure used to activate these adhesives can present significant problems in connection with the lamination of products designed to display coins. Heat affects the bubbles, and frequently causes the flanges to adhere to the card stock. As a result, where the rotatable coin bubbles are desired, it is typically necessary to break the coin bubbles loose from the card stock after the heat and pressure sealing process so that the bubbles will rotate easily. This adds significant costs to the manufacture of rotatable coin displays, and can render large-scale commercial production of such products prohibitively expensive.

SUMMARY OF THE INVENTION

The present invention is directed to a display for a collectible item, such as a coin or medal, in which the collectible item may be rotated relative to the display. In one embodiment, the display comprises a bubble, which can be a semi-rigid transparent material, supported by at least two support layers, which can be a rigid material such as card-stock. The bubble includes a transparent capsule which encapsulates the collectible item, the transparent capsule having an outer diameter that is proportional to the outer diameter of the collectible item. The bubble also includes a flange which extends from the outer perimeter of the capsule. The first support layer includes an opening through the layer, and is arranged so that the flange contacts the back side of the support layer, while the central axis of the capsule is substantially collinear with the central axis of the opening. A second support layer is adhered to the back surface of the first layer and also contacts the flange, so that the bubble is supported between the first and second support layers, while the capsule (and collectible item) are visible through the hole in the first layer. The first and second support layers can be adhered to one another by one or more adhesive layers, which can comprise a heat and pressure-activated adhesive. Also, in some embodiments, the second support layer can include an opening as in the first layer, so that both the front and back sides of the collectible item can be viewed.

The display can also include an apparatus for rotatably securing the flange of the bubble between the first and second support layers so that the bubble may be rotated relative to the first and second layers of support material. This can comprise, for example, a layer of a smooth, heat-resistant coating, such as a high-gloss UV coating, applied to a portion of the back surface of either the first or second support layer, or to both layers. Generally, the smooth heat-resistant coating is applied to the support layer(s) over the region in which the layer(s) contact the flange of the bubble. The apparatus helps prevent the flange from adhering to the support layers, and facilitates the rotation of the bubble within the display.

According to another aspect, the display can also include a third support layer between the first and second support layers. The third layer can include an opening having an outer diameter that is substantially equal to, or greater than, the outer diameter of the flange of the bubble. The third layer is adhered to each of the first and second layers via an adhesive, such as a heat and pressure-activated adhesive, and is arranged such that the central axis of the capsule is substantially collinear with the central axis of the third layer. Preferably, the thickness of the third layer is approximately equal to the thickness of the flange. This helps prevent the formation of undesirable "humps" in the display caused by the added thickness of the flange. With the use of the third support layer, a flat sealing head can be used to produce the laminated display assembly, which can help reduce production costs.

The present invention also relates to a method for producing a display for a collectible item, such as a coin, so that the collectible item may be rotated within the display. According to one aspect, the method comprises encapsulating a collectible item within a bubble, which can be a semi-rigid transparent material, where the bubble includes a capsule for encapsulating the item and a flange extending from the outer perimeter of the capsule. The bubble is arranged between two support layers, which can be a rigid material such as card stock, and at least one of the layers has an opening with outer diameter that is substantially equal to an outer diameter of the capsule. The bubble is arranged between the two layers so that the capsule is aligned within the opening and the flange contacts the two layers of support material.

The method further comprises providing an adhesive between the first and second layers, and providing an apparatus for rotatably securing the flange of the bubble between the first and second layers so that the rotational alignment of the collectible item may be adjusted by rotating the bubble relative to the first and second support layers. The adhesive between the first and second layers can be, for example, a heat and pressure activated adhesive. In a preferred embodiment, providing the apparatus for rotatably securing the flange between the first and second layers comprises applying a layer of smooth, heat-resistant coating, such as a high-gloss UV coating, to a portion of at least one of the support layers such that the flange of the bubble contacts the layer of smooth heat-resistant coating.

The method also comprises adhering the first and second layers together so that the bubble is supported between the first and second layers of support material. This can be accomplished, for example, by providing heat and pressure to the layers of the display.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
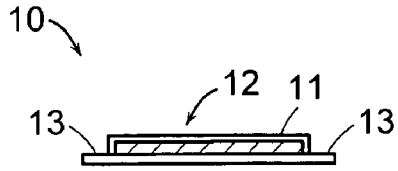
FIG. 1 is a side view of a coin sealed within a transparent coin bubble according to one aspect of the invention.
Figure 2:
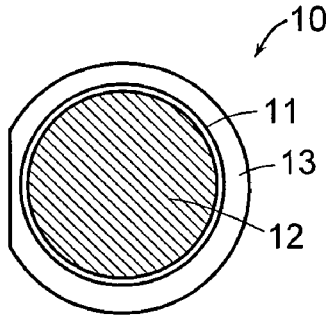
FIG. 2 is a front view of the coin and bubble of FIG. 1.

FIG. 1 is a side view of a coin 11 encapsulated within a bubble 10. The bubble is preferably comprised of a semi-rigid transparent material, such as a plastic, that is vacuum-formed to the size and shape of the coin. As shown in FIG. 2, the bubble 10 includes a central capsule 12 containing the coin 11, where the shape of the capsule is roughly commensurate with the shape of the coin. The bubble also includes a flange 13 which extends from the outer perimeter of the capsule 12.

The bubble can comprise two separate pieces that are joined together to encapsulate the coin. In other embodiments, the bubble can comprise a single piece that is folded over to form a central capsule and the flange.

Figure 3:
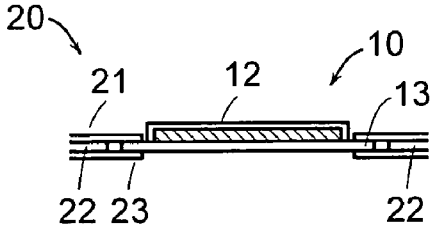
FIG. 3 is a cross-sectional view of a rotatable coin display according to one embodiment of the invention.

FIG. 3 is a cross-section of a laminated assembly 20 with a rotatable coin bubble 10. The laminated assembly includes three layers of a rigid or semi-rigid material, such as card stock, which support the bubble 10 in the display, while permitting rotation of the coin and bubble in the display. The flange 13 of the coin bubble 10 is held between the top layer 21 and bottom layer 23 of the laminate assembly 20. The top and bottom layers 21, 23 of the assembly 20 each include an opening for the capsule 12. The diameter of each opening is equal to or slightly larger than the diameter of the capsule 12, so that when the bubble and coin are secured in the assembly, both sides of the coin are fully visible. It will be understood that in other embodiments, only one of the top and bottom layers can contain an opening so that only one side of the coin is visible.

The assembly 20 also comprises a middle layer 22 which includes an opening that is slightly larger than the diameter of the flange portion 13 of the bubble, so that the flange 13 is within the opening. Preferably, the thickness of the middle layer 22 of the assembly is essentially the same as the thickness of the flange 13. This eliminates the formation of a "hump" or bulge in the laminate structure resulting from the added thickness of the flange.

Figure 4:
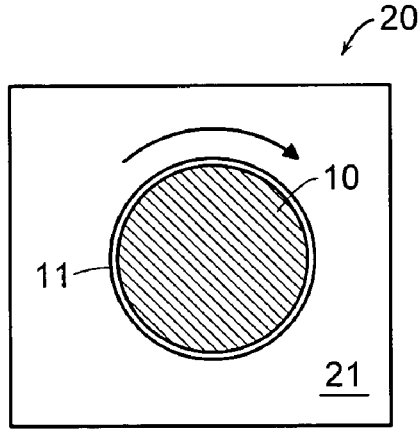
FIG. 4 is a front view of the rotatable coin display of FIG. 3.

A front view of the laminated assembly 20 with the coin bubble 10 is shown in FIG. 4. The rotational alignment of the coin 11 within the assembly 20 can be easily adjusted by rotating the bubble 10 with respect to the assembly 20, as indicated by the arrow. This can be done, for example, by grasping the one side of the coin capsule between the thumb and forefinger, and rotating the capsule relative to the display. Also, the coin could be rotated by holding both sides of the capsule between two fingers and rotating the capsule relative to the display.

Although these illustrations focus on an area of the display in which a single coin is displayed and mounted within a rotatable coin bubble, it will be understood that a given display can be of almost any size and shape, and could contain multiple coins. The laminate assembly can also be imprinted with text and/or graphics on any one of the top, middle, or bottom layers.

Figure 5A:
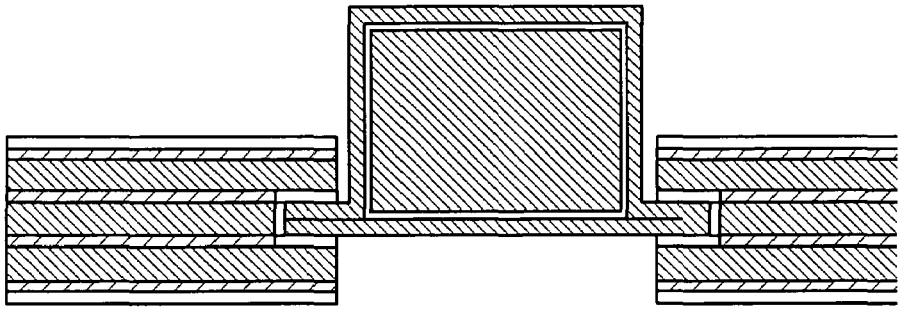
FIG. 5A is a schematic cross-sectional view of a rotatable coin display assembly.
Figure 5B:
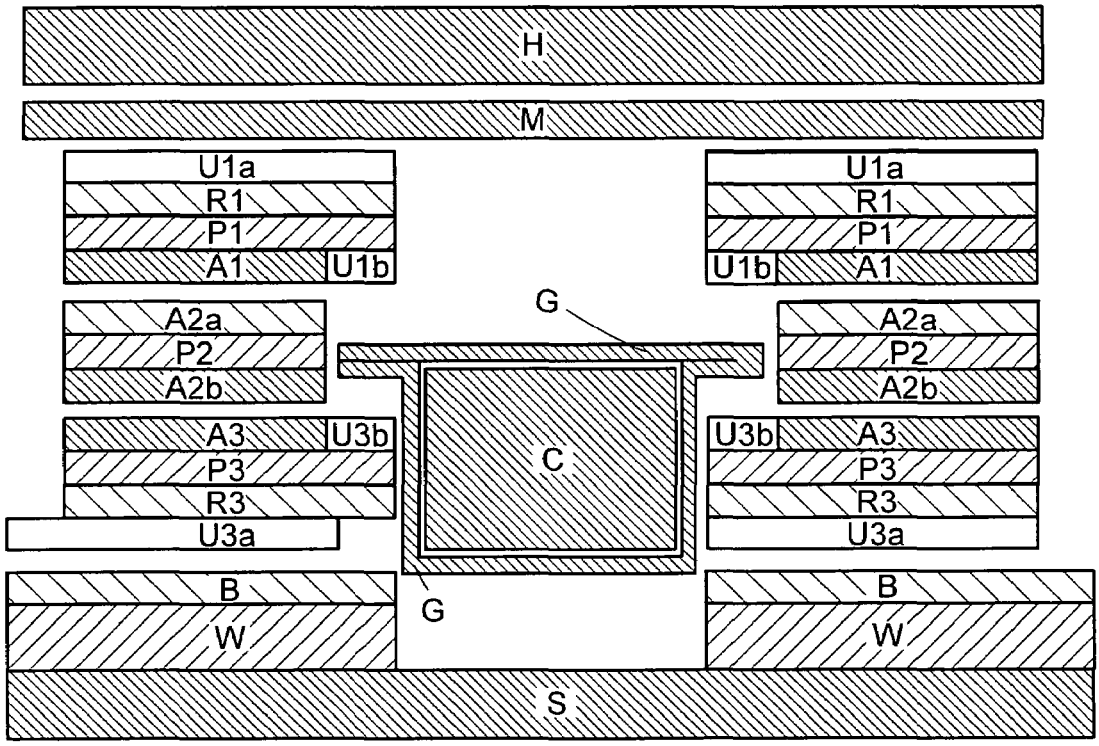
FIG. 5B is a schematic cross-sectional view of the display components and associated equipment used to manufacture the display of FIG. 5A.

Turning now to FIGS. 5A and 5B, a schematic cross-sectional view of a rotatable coin display assembly is shown in FIG. 5A, and FIG. 5B illustrates the display components and associated equipment (identified by key letters) used to manufacture the display. As in the embodiment previously described with reference to FIGS. 1–4, the illustrations in FIGS. 5A and 5B focus on an area of the display in which a single coin is displayed. It will be understood that a given display apparatus can have virtually any size or shape, and could include multiple coins.

In the embodiment shown here, a paper-based material, P1 and P3, such as 16 point card stock coated with a clay coating (e.g., C2S Carolina Cover), is optionally printed with a variety of graphic and text designs using inks R1 and R3, respectively. After printing, the card stock layers P1 and P3 are coated with a high-gloss heat-resistant transparent coating, U1*a* and U3*a,* which is preferably a UV cured coating.

On the reverse side of the card stock layers, P1 and P3, the layers are selectively coated with a heat and pressure-activated adhesive, A1 and A3, which can be, for instance, a Latiseal-brand adhesive. The adhesive does not extend into the region of the card stock which will eventually contact the flange of the coin bubble. In this region, the card stock is selectively coated with a high-gloss heat-resistant material, U1*b* and U3*b,* which can be the same high-gloss heat-resistant coating as coatings U1*a* and U3*a*. In the finished display, coatings U1*b* and U3*b* help prevent the flange of the coin bubble from adhering to either of the card stock layers, P1 and P3, and facilitate the rotation of the coin within the display.

Alternatively, the heat and pressure activated adhesive layers, A1 and A3, can be coated over the entire reverse sides of card stock layers, P1 and P3. Then, the high-gloss heat-resistant material, U1*b* and U3*b*, are selectively coated over the adhesive in the regions that will contact the flanges.

Next, a paper-based material P2, which can be the same 16 point card stock coated with clay coating as layers P1 and P3, is selectively coated on both sides with a heat and pressure-activated adhesive, A2*a* and A2*b,* preferably Latiseal-brand.

The sheets of card stock P1 and P3 are die-cut with a circular hole which is approximately the same diameter as the outside diameter of the capsule portion of the coin bubble, G. The card stock layer P2 is also die-cut with a circular hole. This hole is larger than the holes in sheets P1 and P3, and is typically approximately the same diameter as, or slightly larger than, the outside diameter of the flange portion of the coin bubble, G.

To manufacture the laminated display assembly, a bed structure is used to receive the various display components and to aid in the sealing process. The bed comprises a support surface, S, and a bed, W, which includes a hole that is slightly larger than the outer diameter of the coin capsule. The bed is also layered with a compressible blanket material, B, that is preferably substantially free of surface imperfections. The blanket can be, for example, a ground surface compressible blanket such as commonly used for web offset, sheet-fed, and box board printing applications. Preferably, this material will not adhere to the coating U3*a,* even at the temperatures required for sealing the laminate structure.

To manufacture the finished product, the (optionally) printed, coated, and dye-cut card-stock material P3 is placed onto the bed so that the hole in the card stock aligns with the hole in the bed. Next, the coated and die-cut material P2 is placed on top of P3, and the layers are properly aligned so that the die-cut hole in layer P3 is concentric with the larger-diameter hole in layer P2.

The coin bubble G containing a coin C is then placed through the hole of sheet P3 and into the corresponding hole in the bed, B, so that the flange of the coin bubble is within the dye-cut hole of P2 and contacts against the high-gloss surface of layer P3. The coin bubble, G, is preferably made from a transparent plastic material, such as polyethelyne terephthalate-glycol-modified (PETG). A PETG material is preferred because it is extremely clear, non-reactive, impact resistant, and easily forms at low temperatures. The coin bubble may be sealed closed, although it is generally not necessary to seal the bubble, since the structure of the finished display will maintain the coin inside the bubble.

After the bubbles, G, are inserted, the (optionally) printed, coated, and die-cut material P1 is placed on top of P2. The hole cut in P1 is aligned over the capsule portion of the bubble G, so that the coin contained within the capsule is visible through the hole. A protective layer of material, M, having suitable thickness, such as Mylar-brand PET film, can be placed over the P1 layer to prevent the heat and pressure plate, H, from adhering to coating U1*a* of P1. Preferably, the protective film layer M will not melt or adhere to the sealing head H or to the coating U1*a* at the temperatures required for sealing the laminate assembly.

Heat and pressure are then applied by sealing head H, which is preferably a smooth and polished aluminum plate, which causes product to be laminated with the coin bubble remaining rotatable. Typically, the temperature at the surface of the sealing head H is approximately 260° F., the pressure applied is about 150 pounds per square inch, and the dwell time (i.e. total amount of time that heat and pressure are applied) is generally between 3 and 8 seconds, and is typically about 7 seconds.

While this invention has been particularly shown and described with references to preferred embodiments thereof, it will be understood by those skilled in the art that various changes in form and details may be made therein without departing from the scope of the invention encompassed by the appended claims. For instance, while the embodiments shown here relate to rotatable displays for circularly-shaped coins, it will be understood that the principles of the present invention could similarly apply to displays for numerous other articles having varying shapes and sizes.

While this invention has been particularly shown and described with references to preferred embodiments thereof, it will be understood by those skilled in the art that various changes in form and details may be made therein without departing from the scope of the invention encompassed by the appended claims.

What is claimed is:

1. A display for a collectible item, comprising:

a bubble comprising a transparent capsule which encapsulates a collectible item, the capsule having an outer diameter that is slightly larger than an outer diameter of the collectible item, and a flange extending from an outer perimeter of the capsule;

a first support layer comprising a first surface, a second surface, and an opening extending through the layer, the opening having an outer diameter that is sufficient in size to enable the capsule to rotate within the opening, the first layer being arranged such that the flange of the bubble contacts the second surface of the first support layer and wherein a central axis of the capsule of the bubble is substantially collinear with a central axis of the opening of the first layer;

a second support layer comprising a first surface and a second surface, the second surface of the second layer being adhered to the second surface of the first layer so that the bubble is supported between the first and second support layers; and an apparatus for rotatably securing the flange of the bubble between the first and second support layers so that the alignment of the collectible item may be adjusted by rotating the bubble relative to the first and second support layers; the rotation of the bubble being about an axis that is substantially collinear with the central axis of the capsule of the bubble.

2. The display of claim 1 wherein the second support layer further comprises an opening extending through the second layer, the opening having an outer diameter that is substantially equal to the outer diameter of the capsule, the second layer being arranged such that the flange of the bubble contacts the second surface of the second layer and a central axis of the capsule of the bubble is substantially collinear with a central axis of the opening of the second layer.

3. The display of claim 1 wherein the collectible item comprises a coin.

4. The display of claim 1 further comprising:

a third support layer comprising an opening having an outer diameter that is substantially equal to or greater than an outer diameter of the flange of the bubble, the third layer being adhered to the back surface of the first layer and the back surface of the second layer and arranged such that a central axis of the capsule is substantially collinear with a central axis of the opening of the third layer.

5. The display of claim 4, wherein the third support layer has a thickness that is substantially equal to a thickness of the flange.

6. The display of claim 4, wherein at least one of the first, second, and third support layers comprise a paper-based material.

7. The display of claim 6, wherein the paper-based material comprises card stock.

8. The display of claim 1 wherein the bubble comprises a semi-rigid transparent material.

9. The display of claim 8, wherein the bubble comprises plastic.

10. The display of claim 1, further comprising an adhesive layer selectively applied to the second surface of at least one of the first and second support layers, and not applied to the area in which the flange contacts the first and second support layers.

11. The display of claim 10, wherein the adhesive layer comprises a heat and pressure-activated adhesive.

12. The display of claim 1, wherein the display comprises a plurality of bubbles supported between the first and second layers.

13. A display for a collectible item, comprising:

a bubble comprising a transparent capsule which encapsulates a collectible item, the capsule having an outer diameter that is slightly larger than an outer diameter of the collectible item, and a flange extending from an outer perimeter of the capsule;

a first support layer comprising a first surface, a second surface, and an opening extending through the layer, the opening having an outer diameter that is sufficient in size to enable the capsule to rotate within the opening, the first layer being arranged such that the flange of the bubble contacts the second surface of the first support layer and wherein a central axis of the capsule of the bubble is substantially collinear with a central axis of the opening of the first layer;

a second support layer comprising a first surface and a second surface, the second surface of the second layer being adhered to the second surface of the first layer so that the bubble is supported between the first and second support layers; and an apparatus for rotatably securing the flange of the bubble between the first and second support layers so that the alignment of the collectible item may be adjusted by rotating the bubble relative to the first and second support layers; wherein the apparatus for rotatably securing the flange of the bubble between the first layer and second support layers comprises a layer of a smooth, heat-resistant coating applied to a portion of the second surface of at least one of the first support layer and the second support layer such that the flange of the bubble contacts the layer of smooth heat-resistant coating.

14. The display of claim 13, wherein the smooth heat-resistant coating comprises a high-gloss UV coating.

15. A method for producing a display for a collectible item, comprising:

encapsulating a collectible item within a bubble, the bubble comprising a transparent capsule which encapsulates the item, and a flange extending from an outer perimeter of the capsule;

arranging the bubble between first and second support layers, the first support layer comprising an opening extending through the first support layer, the opening having an outer diameter that is substantially equal to an outer diameter of the capsule, the bubble being arranged so that a central axis of the capsule is substantially collinear with the central axis of the opening and the flange lies between, and contacts with, the first and second support layers;

providing an adhesive between the first and second support layers;

providing an apparatus for rotatably securing the flange of the bubble between the first and second support layers so that the rotational alignment of the collectible item may be adjusted by rotating the bubble relative to the first and second support layers; the rotation of the bubble being about an axis that is substantially collinear with the central axis of the capsule; and adhering the first and second support layers together.

16. The method of claim 15 further comprising:

providing a third support layer comprising an opening extending through the third layer, the opening having an outer diameter that is substantially equal to or greater than an outer diameter of the flange of the bubble, the third layer being adhered to the first and second layers of support material and arranged such that a central axis of the capsule is substantially collinear with the central axis of the opening of the third layer.

17. The method of claim 15 wherein the step of adhering the first and second layers together comprise providing heat and pressure to the layers.

18. The method of claim 15 wherein the collectible item comprises a coin.

19. A method for producing a display for a collectible item, comprising:

encapsulating a collectible item within a bubble, the bubble comprising a transparent capsule which encapsulates the item, and a flange extending from an outer perimeter of the capsule;

arranging the bubble between first and second support layers, the first support layer comprising an opening extending through the first support layer, the opening having an outer diameter that is substantially equal to an outer diameter of the capsule, the bubble being arranged so that a central axis of the capsule is substantially collinear with the central axis of the opening and the flange lies between, and contacts with, the first and second support layers;

providing an adhesive between the first and second support layers;

providing an apparatus rotatably securing the flange of the bubble between the first and second support layers so that the rotational alignment of the collectible item may be adjusted by rotating the bubble relative to the first and second support layers; and adhering the first second support layers together, wherein the apparatus for rotatably securing the flange of the bubble between the first and second support layers comprises applying a layer of a smooth heat-resistant coating to a portion of at least one of the support layers such that the flange of the bubble contacts the smooth heat-resistant coating.

20. The method of claim 19, wherein the smooth heat-resistant coating comprises a high-gloss UV coating.

21. A display for a collectible item, comprising:

a capsule which encapsulates a collectible item, the capsule having an outer dimension that is slightly larger than an outer dimension of the collectible item, and a flange extending from the outer dimension of the capsule;

a first support layer comprising a first surface, a second surface, and an opening extending through the layer, the opening having an outer dimension that is sufficient in size to enable the capsule to rotate within the opening, the first support layer being arranged such that the flange of the capsule contacts the second surface of the first support layer and wherein a central axis of the capsule is substantially collinear with a central axis of the opening of the first support layer;

a second support layer comprising a first surface and a second surface, the second surface of the second support layer being adhered to the second surface of the first support layer so that the capsule is supported between the first and second support layers; and an apparatus for rotatably securing the flange of the capsule between the first and second support layers so that the alignment of the collectible item may be adjusted by rotating the capsule relative to the first and second support layers; the rotation of the capsule being about an axis that is substantially collinear with the central axis of the capsule of the bubble.

22. The display of claim 21, wherein the display comprises a plurality of said capsules.

23. The display of claim 21, wherein the outer dimension of the capsule is a diameter of a circle or a diagonal of a rectangle or square.

* * * * *

UNITED STATES PATENT AND TRADEMARK OFFICE

CERTIFICATE OF CORRECTION

PATENT NO. : 7,100,761 B2
APPLICATION NO. : 10/661374
DATED : September 5, 2006
INVENTOR(S) : James A. Helzer and Max A. DeHerrera It is certified that error appears in the above-identified patent and that said Letters Patent is hereby corrected as shown below:

Claim 17, column 8, line 48, “comprise” should be --comprises--.

Signed and Sealed this

Fifth Day of December, 2006

JON W. DUDAS
*Director of the United States Patent and Trademark Office*